United States Patent [19]

Deutsch

[11] 4,273,018

[45] Jun. 16, 1981

[54] NONLINEAR TONE GENERATION IN A POLYPHONIC TONE SYNTHESIZER

[75] Inventor: Ralph Deutsch, Sherman Oaks, Calif.

[73] Assignee: Kawai Musical Instrument Mfg. Co., Ltd., Hamamatsu, Japan

[21] Appl. No.: 155,327

[22] Filed: Jun. 2, 1980

[51] Int. Cl.[3] ..... G10H 1/06; G10H 1/02

[52] U.S. Cl. ..... 84/1.22; 84/1.01; 84/1.27

[58] Field of Search ..... 84/1.01, 1.19, 1.22, 84/1.27, 1.03, 1.24

[56] References Cited

U.S. PATENT DOCUMENTS

| | | | |
|---|---|---|---|
| 3,908,504 | 9/1975 | Deutsch | 84/1.27 |
| 4,085,644 | 4/1978 | Deutsch et al. | 84/1.01 |
| 4,122,742 | 10/1978 | Deutsch | 84/1.19 |
| 4,135,427 | 1/1979 | Deutsch | 84/1.22 |
| 4,175,464 | 11/1979 | Deutsch | 84/1.19 |
| 4,194,426 | 3/1980 | Deutsch et al. | 84/1.27 |
| 4,214,503 | 7/1980 | Deutsch | 84/1.27 |

*Primary Examiner*—J. V. Truhe
*Assistant Examiner*—Forester W. Isen
*Attorney, Agent, or Firm*—Ralph Deutsch

[57] ABSTRACT

In a musical instrument having one or more tone generators in which a plurality of data words are transferred sequentially from note registers in repetitive cycles at rates proportional to the pitches of tones being generated, apparatus is provided for varying the spectral content of tones having both harmonic and nonharmonic overtones. Control signals are used to vary the amplitudes of the overtones. An independent formant control signal causes the tones to have a time variant spectral quality.

12 Claims, 6 Drawing Figures

NONLINEAR TONE GENERATION IN A POLYPHONIC TONE SYNTHESIZER

BACKGROUND OF THE INVENTION

1. Field of the Invention

This invention relates broadly in the field of electronic musical tone generators and in particular is concerned with apparatus for producing tones with time variant spectral characteristics with nonharmonic overtones varied in response to a loudness control signal.

2. Description of the Prior Art

An elusive goal in the design of electronic musical instruments is the ability to realistically imitate the sounds produced by the familiar family of conventional acoustic type musical instruments. The best results have been obtained for electronic musical instruments which imitate wind-blown organs and harpsichords. The principal reason for obtaining good imitative results for these instruments is that they are essentially mechanical tone generators. The tone generation is automatic and the musician only actuates on-off switches. With the notable exception of these two instruments, the tone character of almost all other musical instruments is a function of certain skills possessed by the musician.

It has long been recognized that with the exception of conventional organ tones, almost all tone produced by musical instruments exhibit tone spectra which are time variant. The recognition of the characteristic time variant spectra has motivated the development of electronic music generating systems such as those known by the generic names of "sliding formant" and "FM-synthesizer." Sliding formant tone generators constitute a class of generators which are also called subtractive synthesis. In subtractive synthesis, the fundamental tone source generates more than the desired tone spectral components and the undesired spectral components are attenuated, or filtered out, by means of some variety of frequency filter. The FM-synthesizer is of the additive variety in that FM (frequency modulation) is used to add components to a source signal which often consists of a simple single frequency sinusoid time function.

Part of the problem in trying to synthesize musical instrument sounds rests in the inability to adequately model many of the subtleties in tone structure imparted by the musician in an effective performance on his instrument. The musician commonly uses a technique such that the tonal structure for a given musical note varies with the loudness of the tone. Repeated notes are played with different loudness and tonal structures. It is these subtle differences that differ from the mechanical-like repeated tones produced by most electronic musical tone generators. Even very expert players are unable to repeat a given tone with precisely the same identical tone spectra. In general, as the tone level becomes louder, the tone spectra increases in the number and strength of the higher harmonics. Very soft tones tend to approach tones having only a few harmonics.

To compound the task of imitating musical instruments is the fact that even a sustained tone does not have a constant tone spectra. For almost all instruments it is well-known that the spectrum will change with time and change with the tone's instantaneous amplitude envelope. Such time variant spectralal variations have been introduced into electronic musical instruments using synthesis techniques such as the sliding formant and FM-synthesizer.

In the copending patent application Ser. No. 139,908 filed Apr. 14, 1980 entitled "A Polyphonic Tone Synthesizer With Loudness Spectral Variation" a system is disclosed whereby a loudness control system is used to vary the spectral content of generated musical tones. The referenced patent application and the present invention are assigned to the same assignee. The invention disclosed in the application describes means for causing a tone generator of the type described in U.S. Pat. No. 4,085,644, entitled "Polyphonic Tone Synthesizer," to produce musical tones having spectral components which can be made to be time variant in response to a control signal such as the note's ADSR envelope function or the setting of a loudness control signal.

In a Polyphonic Tone Synthesizer of the type described in the referenced patent, a computation cycle and a data transfer cycle are repetitively and independently implemented to provide data which are converted into musical waveshapes. During the computation cycle a master data set is generated having a spectral content which is variable in response to an input loudness control signal. This is accomplished by utilizing a table of stored sinusoid values to address data values from a transform memory which contains a preselected set of data points. The sinusoid function values are scaled in magnitude in response to the input loudness control signal thereby causing a variable subset of the transform memory contents to be read out and stored in a main register. These operations are executed at a fast rate which may be nonsynchronous with any musical frequency.

Following a computation cycle, a transfer cycle is initiated during which the master data set is first adjusted to have a zero average value and is then transferred to selected members of a multiplicity of note registers. The data residing in the note registers are read out in response to note clocks having frequencies corresponding to the assigned corresponding keyboard switches. This data is read out sequentially and repetitively and converted to analog musical waveshapes. Tone generation continues uninterrupted during the computation and the transfer cycles.

The usual method of producing time variant spectral changes is to use the sliding formant technique. These techniques are usually implemented by using a frequency-domain filter with controllable cut-off frequencies to process waveshapes generated by analog musical instruments.

A different type of sliding formant tone generation is described in U.S. Pat. No. 3,908,504 entitled "Harmonic Modulation And Loudness Scaling In A Computor Organ" and in the previously referenced U.S. Pat. No. 4,085,644. In these systems the time variation of spectral content is obtained by varying the magnitude of harmonic coefficients used to compute waveshape amplitude points by means of a Fourier-type algorithm. The tonal effects obtained by "sliding" the magnitude of selected harmonic coefficients are very similar to tonal effects obtained by "sliding" the cut-off frequencies of a frequency domain filter.

In the copending patent application Ser. No. 150,493 filed May 16, 1980 entitled "Apparatus For Tone Generation With Combined Loudness And Formant Spectral Variation" a system is disclosed whereby the loudness control spectral variations produced by the system disclosed in the referenced application Ser. No. 139,908 are combined with a means for producing spectral variations of the sliding harmonic type described above.

This is accomplished in a tone generator of the Polyphonic Tone Synthesizer type by partitioning the computation cycle into two segments. During the first segment of the computation cycle a set of transform data values are computed and stored in a transform memory. These values are computed using a generalized Fourier-type algorithm having a preselected set of harmonic coefficients as input data. These harmonic coefficients are scaled in magnitude by means of a formant scaling subsystem to produce transform data values which are varied in spectral content in response to the control signals applied as input data to the formant scaling subsystem. During the second segment of the computation cycle, the data residing in the transform memory are used to create a master data set in a manner analogous to that disclosed in the referenced patent application Ser. No. 139,908. In this fashion the tonal effects of a time varying formant is combined with that of a time varying loudness control.

An application of nonlinear system transformations in the generation of musical sounds is contained in the technical article: Beauchamp, J., "Brass Tone Synthesis by Spectrum Evolution Matching with Nonlinear Functions." *Computer Music Journal,* Vol. 3, No. 2, pp 35–42 (1979).

To imitate certain percussive musical sounds such as chimes and bells it is necessary to generate tones that contain nonharmonic overtones. The FM-synthesizer is one method of generating such tones. Another method is to employ the tonal effect used in musical tone synthesizers which is generically called "ring modulation." In a ring modulator two signals at different frequencies are combined in a manner such that the output signal contains spectral components at the sum and difference frequencies of the original two frequencies. A description of a variety of ring modulators is described in U.S. Pat. No. 4,135,427 entitled "Electronic Musical Instrument Ring Modulator Employing Multiplication Of Signals."

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. During the computation cycle a master data is created and stored in a main register. The computations are executed at a fast rate which may be nonsynchronous with any musical frequency.

Following a computation cycle, a transfer cycle is initiated during which the master data set is transferred to preselected members of a multiplicity of note registers. Tone generation continues uninterrupted during the computation and transfer cycles.

The data points residing in the individual note registers are read out repetitively and sequentially at rates corresponding to actuated keyboard switches.

Two tone production modes are provided. In the first tone production mode, called the independent mode, the data accessed from each note register is scaled in magnitude in response to a corresponding loudness control signal. The scaled data are then used to address output data values from a nonlinear data memory. A digital-to-analog converter converts these output data values into analog signals producing the desired musical sounds. For the second tone production mode, called the interactive mode, the scaled outputs from a combination of note registers are added together and the summed signal is used to address output data from a nonlinear data memory thereby creating a tone of the ring modulator type.

It is the object of the present invention to create tones that vary independently in spectral content in response to each actuated keyswitch.

It is a further object of this invention to produce musical tones having nonharmonic overtones that vary with the actuated keyswitches and their associated loudness control signals.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

Figure 1:
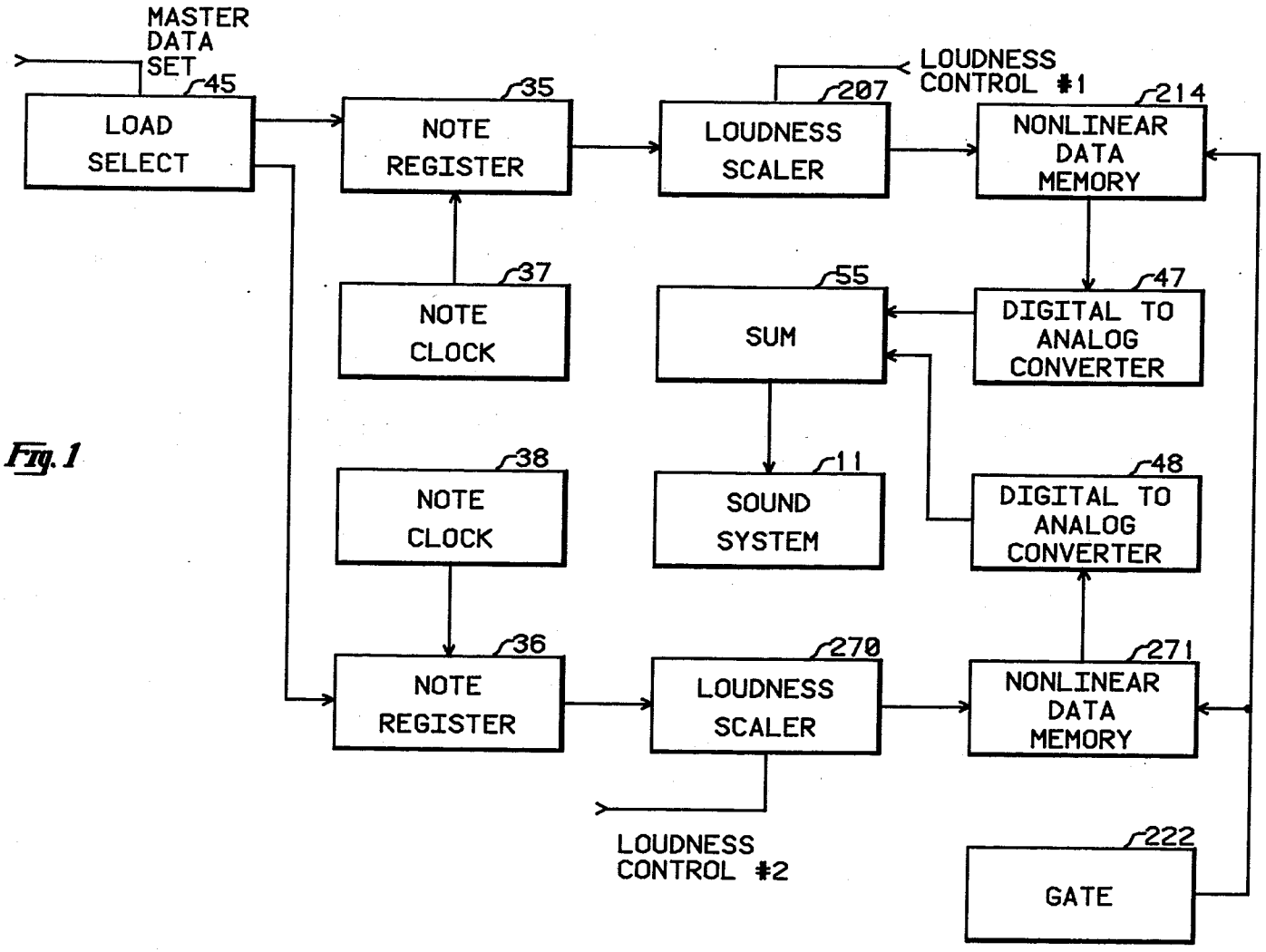
FIG. 1 is a schematic block diagram of an embodiment of the invention.

FIG. 1 shows an embodiment of the present invention which is shown and described as a modification to the system described in detail in U.S. Pat. No. 4,085,644 entitled "Polyphonic Tone Synthesizer" which is hereby incorporated by reference. All two-digit reference numbers used in the drawings correspond to the similarly numbered elements in the disclosure of the above-identified patent.

Figure 2:
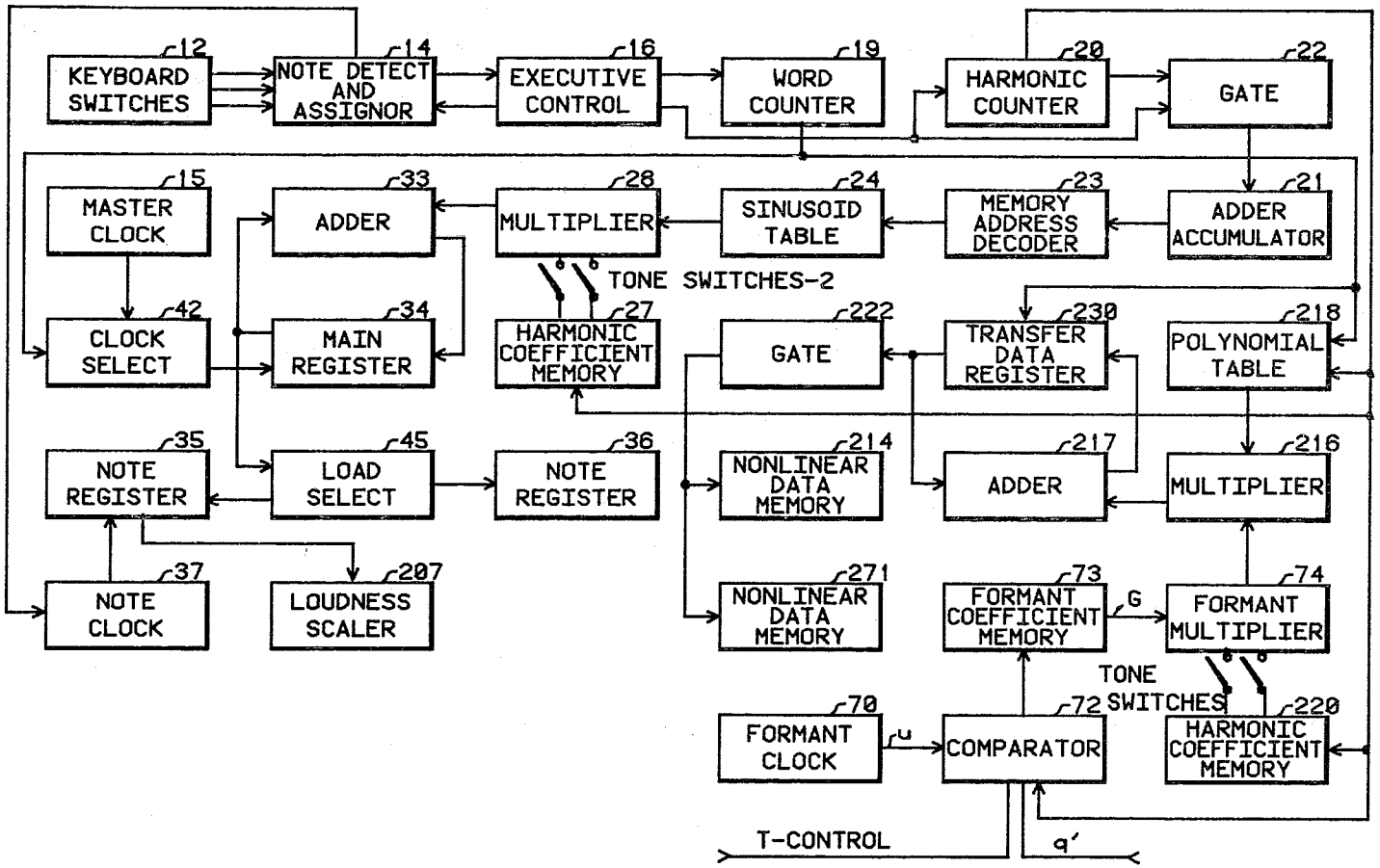
FIG. 2 is a schematic block diagram illustrating the generation of the nonlinear data values.

The data values stored in the nonlinear data memories 214 and 271 can be generated using the system shown in FIG. 2. As described in the referenced patent, the Polyphonic Tone Synthesizer includes an instrument keyboard comprising the keyboard switches 12 which, for example, corresponds to the conventional keyboard of an electronic musical instrument such as an electronic organ. By depressing one or more keys on the instrument keyboard, a note detect and assignor circuit 14 stores the note information for the keys that have been actuated and assigns each actuated note to one of twelve separate tone generators. A note detect and assignor circuit is described in U.S. Pat. No. 4,022,098 which is hereby incorporated by reference. When one or more keys has been depressed, an executive control circuit 16 initiates a computation cycle during which a master data set is computed and stored in main register 34 and a set of transfer data values are computed and stored in the transfer data register 230. These data sets consist of 64 data values. The general rule is that the number of harmonics in the output tone spectra cannot exceed one-half of the number of data points contained in the master data set which corresponds to one complete cycle of a waveshape.

The master data set and the transfer data set are computed during a computation cycle of a sequence of computation cycle. The method of computing these data set closely follows that described in the copending patent application Ser. No. 150,493 filed May 16, 1980 and entitled "Apparatus For Tone Generation With Combined Loudness And Formant Spectral Variation." The referenced patent application and the present invention are assigned to the same assignee.

The computation cycle is divided into two consecutive subcomputation cycles. During the first subcomputation cycle a set of transform data values are generated from a set of harmonic coefficient values and stored in the transfer data memory 230. During the second subcomputation cycle a master data set is generated in the manner described in U.S. Pat. No. 4,085,644. The master data set is stored in the main register 34.

The transfer data values z(N) stored in the transfer data memory 230 are computed according to the relation $$z(N) = \sum_{q=1}^{M} c_q T_q(N') \qquad \text{Eq. 1}$$

$c_q$ are elements of a set of harmonic coefficients that are stored in the harmonic coefficient memory 220. Different sets of harmonic coefficients are selected by actuating combinations of the tone switches controlling data addressed out from the harmonic coefficient memory 20 which may contain a multiplicity of sets of harmonic coefficients. The values of $c_q$ accessed from this memory are scaled in magnitude by the formant multiplier 74 in a manner described later. M is a preselected number that indicates the total number of harmonics to be used in evaluating the transform data values. M is advantageously restricted to be no greater than one-half of the number of elements in the master data set. The symbol $T_q(N')$ denotes a Chebyschev polynomial of the first kind with index q and argument N'.

$$N' = \cos(\pi N/32) \qquad \text{Eq. 2}$$

where N is an integer in the range N=1, . . . , 64. N will correspond to the count states of the word counter 19.

The method for generating valves of the transfer data values z(N) is analogous to that described in the referenced U.S. Pat. No. 4,085,644 for generating a master data set using a generalized Fourier-type algorithm employing orthogonal polynomials. The Chebychev polynomials are orthogonal polynomials. The term orthogonal functions is used here in a generic sense to include both orthogonal polynomials and orthogonal functions.

Values of the Chebychev polynomials are stored in the polynomial table 218. For the case in which the master data set comprises 64 words corresponding to a maximum of 32 harmonics, the polynomial table is configured as a set of 32 addressable memories each of which contains 64 data words.

During the first subcomputation cycle, word counter 19 counts timing signals furnished by the system master logic clock 37, modulo 64. The harmonic counter 20 and the word counter 19 are initialized at the start of the first subcomputation cycle by a signal furnished by the executive control 16. The harmonic counter 20 is incremented each time that the word counter 16 returns to its lowest count state.

The contents of the harmonic counter 20 are used to selectively address one of the 32 addressable memories contained in the polynomial table 218. The particular word in the memory chosen by the harmonic counter is selected by the state of the word counter 19.

The Chebychev polynomial data value selected and addressed out from the polynomial table 218 is multiplied by a scaled value of a selected harmonic coefficient in the multiplier 216. The harmonic coefficients $c_q$ are stored in the harmonic coefficient memory 220 and values are addressed out in response to the contents of the harmonic counter 20.

At each logic clock time in the first subcomputation cycle, a data value is addressed out of the transfer data register 230 at an address corresponding to the state of the word counter 19. The addressed data values are added by the adder 217 to the product value generated by the multiplier 216. The summed value is then written into the transfer data register 230. The net result is that at the end of the first subcomputation cycle the transfer data register 230 contains a set of values corresponding to the relation given by Eq. 1 The transfer data register is initialized to zero value at the start of a first subcomputation cycle.

The harmonic coefficients stored in the harmonic coefficient memory 220 can be any set of values for producing selected musical tone colors or spectral content. Advantageously these can have values selected to produce a desired tone for the maximum value of the loudness control signal in the absence of a modification, or scaling, by the harmonic formant subsystem.

The addressed values of the harmonic coefficients $c_q$ are modified by the formant coefficients in the formant multiplier 74 using a formant control system which is described in the previously referenced U.S. Pat. No. 4,085,644. The current value of the harmonic number q, as determined by the state of the harmonic counter 20, is sent to the comparator 72. q' is the harmonic number that determines the effective cut-off harmonic number for a low-pass harmonic formant filter. q' is an input value to the formant system which can be supplied by any of a wide variety of numerical input data means. The formant clock 70 provides a timing means for providing a time varying value u as an input to the comparator 72. At each bit time of the first subcomputation cycle, comparator 72 compares the value of q+u with the selected input value of q'. If q+u is less than or equal to q', a value Q'=1 is sent to the formant coefficient memory 73. If at some bit time it is found that q+u is greater than q', the value Q'=q+u−q' is transmitted as a data address to the formant coefficient memory 73. In response to the received address, a formant coefficient G is accessed out from the formant coefficient memory 73. The formant multiplier 74 multiplies the current value $c_q$ addressed out from the harmonic coefficient memory 220 by the value G to form a scaled harmonic coefficient.

Suitable values for the formant coefficients G are listed in the referenced U.S. Pat. No. 4,085,644.

The T-CONTROL signal applied to the comparator 72 is used to select either a low pass or high pass formant filter operation. For a high pass operation selected by the T-CONTROL signal, at each bit time comparator 72 compares the value of q+u with the selected input value of q'. If q+u is greater than or equal to the value of q', a value Q'=1 is sent to the formant coefficient memory 73. If at some bit time it is found that q+u is less than q', then the value Q'=q'−(q+u) is transmitted as a data address to the formant coefficient memory 73.

During the second subcomputation a master data set is computed and stored in the main register. The operation of the system elements to generate the master data set is described in the referenced U.S. Pat. No. 4,085,644.

The word counter 19 is incremented at each bit time determined by the logic system master clock 37. The contents of the word counter are selected by the clock select 42 and are used to address data from the main register 34. The contents of the main register are initialized at the start of a computation cycle. The harmonic counter 20 is incremented each time that the word counter 19 returns to its initial state. The adder-accumulator 21 adds the contents of the harmonic counter to the contents of its accumulator. The adder-accumulator 21 is initialized at the start of a computation cycle.

Sinusoid values are addressed out of the sinusoid table 24 by the memory address decoder in response to the value contained in the accumulator of the adder-accumulator 21. The addressed sinusoid values are multiplied by harmonic coefficients accessed from the harmonic coefficient memory 27 in response to the state of the harmonic counter 20.

The tone generation system will operate for any desired selected sets of harmonic coefficients contained in the harmonic coefficient memory 27. These sets are selected by actuating the tone switches. If the musical tones are desired to be those determined primarily by the harmonic coefficients stored in the harmonic coefficient memory 220, then the set of harmonic coefficients addressed from the harmonic coefficient memory 27 should have all zero valus except for the first coefficient. Moreover, the sinusoid table 24 should contain values of trigonometric cosine functions as indicated by Eq. 2.

The selection of alternate sets of harmonic coefficient values from the harmonic coefficient memory provides an additional source of tone variations. These are selected by acuating the tone switches-2.

Following a computation cycle, a transfer cycle is initiated during which the master data set residing in the main register 34 is read out and written into assigned note registers such as note register 35 and note register 36. Also during the transfer cycle the transfer data residing in the transfer data register 230 is transferred to nonlinear data memories 214 and 271 which correspond to note registers 35 and 36.

It is evident that the generation of a master data set is completely independent of the generation of the set of transfer data values. Thus the first and second subcomputation cycles can be carried out simultaneously with the system shown in FIG. 2.

While the harmonic coefficients $c_q$ stored in the harmonic coefficient memory 220 can all have positive values, it is known that if the harmonic coefficients are multiplied by phase numbers $P_q$ then it is possible to maximize the RMS value of the transfer data set values for a prescribed peak signal value limitation imposed by the number of binary bits in a digital word used to represent numerical values. The values or $P_q$ all have the values $+1$ or $-1$. The following set of values or $P_q$ are listed in the referenced U.S. Pat. No. 4,085,644 and have been experimentally verified to produce satisfactory results:

$-1,-1,-1,-1,-1,-1,-1,-1,+1,+1,+1,-1,-1,-$
$-1,+1,+1$ $-1,-1,+1,+1,-1,+1,+1,-1,+1,-1,-1,+1,-1,-$
$+1,-1,+1$

The following alternative set of phase numbers $P_q$ have also been verified to produce satisfactory results:

$+1,-1,+1,+1,+1,-1,-1,+1,+1,-1,+1,+1,+1,-$
$+1,+1,+1,$ $+1,+1,-1,-1,+1,-1,+1,-1,-1,-1,+1,+1,-1,-$
$+1,-1,-1$

The master data set points are transferred out of the note registers 35 and 36 by the associated note clocks 37 and 38 shown in FIG. 1. There is such a note clock associated with each of the multiplicity of tone generators. The note clock can be inmplemented as a voltage controlled oscillator whose frequency is set at 64 times the fundamental musical frequency of the associated keyed note on the instrument's keyboard. In this fashion all 64 master data points are read out of a note register in a time interval corresponding to one period of the pitch, or fundamental frequency, of the selected note.

There are a variety of methods available for implementing the voltage controlled oscillators used for the note clocks 37 and 38. One such method is described in detail in U.S. Pat. No. 4,067,254 entitled "Frequency Number Controlled Clocks" which is hereby incorporated by reference.

The tone generation operation is described for the tone generator comprising the note clock 37, note register 35, loudness scaler 207, nonlinear data memory 214, and the digital-to-analog converter 47. Similar elements comprise each of the other tone generators which are not shown explicitly in the drawings.

The master data set values read out of note register 35 in response to the note clock 37 are scaled in magnitude by the loudness scaler 207 and the scaled values, or scaled addressing data values, are used to address data from the nonlinear data memory 214. The loudness scaler 207 is a data value multiplier in which the multiplier value is varied in response to a loudness control signal (LOUDNESS CONTROL #1). This signal can be obtained from any of a variety of sources depending upon the desired musical effect. Such sources include touch responsive keyboard switches, pressure sensitive keyswitches in which the signal output of the pressure sensor varies with the pressure exerted on the closed keyswitch, the signal output from an ADSR envelope generator, and loudness compensation data.

A method of obtaining a loudness control signal is described in the patent application Ser. No. 19,318, now U.S. Pat. No. 4,214,503, "Electronic Musical Instrument With Automatic Loudness Compensation" which was filed Mar. 9, 1979. This application has a common assignee with the present invention.

For a measure of added realism, a random signal can be added to the loudness control signal so that repeated notes will always differ in spectral content from each other even if the steady state control signal does not change. The loudness scaler 207 can be implemented to contain an addressablee memory storing a set of numbers, or scale factors. These numbers can be addressed out in response to the loudness control signal and used as multipliers to scale, or multiply, the input data read out of the note register 35.

The scaled addressing data input to the nonlinear data memory 214 is processed by an internal memory address decoder. This decoder rounds off the address data to the closest integer value corresponding to the 64 memory addresses storing the transfer data points.

The data addressed out from the nonlinear data memory 214 are converted to an analog signal by means of the digital-to-analog converter 47. The analog musical signals produced by each of the assigned tone generators are combined in the sum 55 and used by the sound system 11 to produce audible musical tones.

Figure 3:
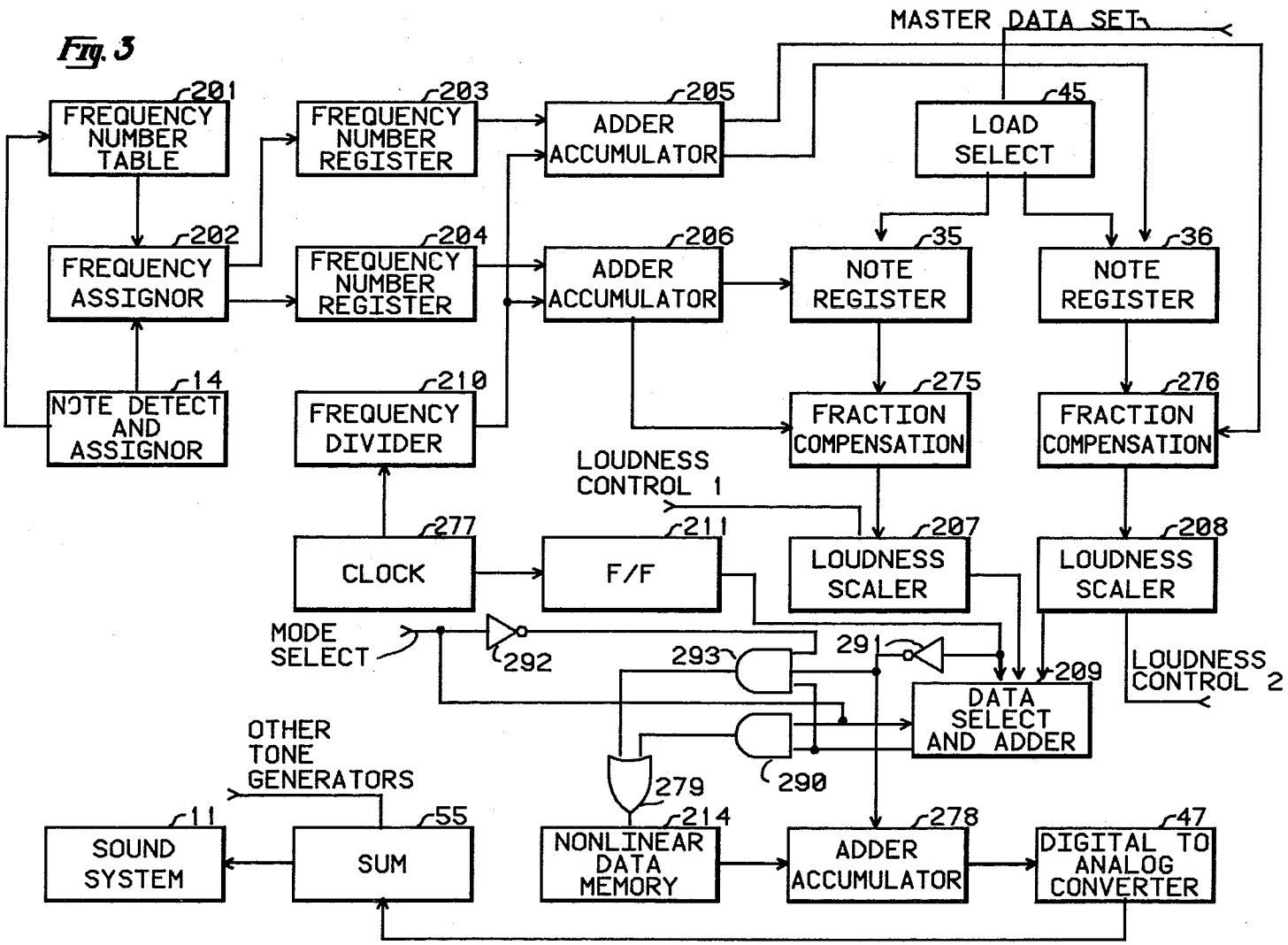
FIG. 3 is a schematic block diagram of an alternative embodiment of the invention.

FIG. 3 shows an alternative implementation in which a plurality of tone generators share a single nonlinear data memory 214 on a time shared basis. In this arrangement the free running note clocks of the voltage controlled oscillator type are not suitable. Instead, it is necessary that all the note clocks be obtained from a common master clock timing source. A method of implementing such synchronized clocks is described in detail in U.S. Pat. No. 4,114,496 entitled "Note Frequency Generator For A Polyphonic Tone Synthesizer" which is hereby incorporated by reference.

When a keyswitch has been actuated, the note detect and assignor 14 causes a corresponding frequency number to be read out of the frequency number table 201. The output frequency numbers are selectively transferred to a frequency number register in each of the tone generators under control of the frequency assignor 202. The frequency numbers are successively added to themselves. Each time the accumulator in an adder accumulator resets itself by an overflow, the overflow signal is sent to shift successive data words from the associated note register. To compensate for noise introduced by the irregular pattern of timing signals produced by such a noninteger frequency divider, fraction compensation 275 and 276 are used. The difference in value between successive data words addressed from a note register such as 35 is computed. A fraction of this difference is selected in response to the contents of the corresponding accumulator in the adder accumulator 205. The fraction of the difference is then added to the current data word read from the note register 35 and then transmitted to the data selected and adder 209.

The master data set values are read out of the note register 35 and the fraction compensation is applied to the values by the fraction compensation 275. The fraction compensated master data set values are scaled in magnitude by the loudness scaler 207 in response to the loudness control 1 signal. In the same fashion, the master data set values are read out of the note register 276, fraction compensated by the fraction compensator 276 and scaled in mangitude by the loudness scaler 208 in response to the loudness control 2 signal.

There are two operation modes for the system shown in FIG. 3. The first operation mode is called the "independent mode" and the second operation mode is called the interactive mode."

When the independent mode of operation is selected, the tone generation for the tone channel starting with note register 35 is independent of the tone generation for the tone channel starting with note register 36. In the independent mode of operation, all the tone generators use a single nonlinear data memory 214 in a conventional time shared manner. While the operation is described for two tone generators, the extension is evident for other numbers of tone generators.

For two tone generators, the clock 277 is operated at two times the system logic clock. The frequency divider 210 is used to translate the clock rate from clock 277 to the system master clock rate so that the adder-accumulators 205 and 206 operate at the rate of master clock 37. The output of the frequency divider 210 can be substituted for master clock 37.

The timing signals from the clock 277 are used to toggle the states of the flip-flop 211. The MODE SELECT signal has the state "0" for the independent mode of operation. In response to the alternating state output of the flip-flop 211 and for state "0" of the MODE SELECT signal, data select and adder 209 tranfers data to the AND-gate 280 and 283. This data is selected in an alternating fashion between the outputs of the loudness scalers 207 and 208. While the signals to the AND gates 280 and 283 and the OR-gate 279 are shown explicitly as single lines in FIG. 3, these are implicit representations of a multi-line signal path to transmit the number of bits in the binary data values.

In the independent mode, the selected data from the loudness scalers is transmitted unaltered to access transfer data values from the nonlinear data memory 214. The data accessed out from the nonlinear data memory 214 in response to the input signals are added and accumulated in the adder-accumulator 278. The accumulator is initialized each time that flip-flop 211 returns to its initial state.

The summed data in adder-accumulator 278 is converted to an analog signal by means of the digital-to-analog converter 47.

When the MODE SELECT signal is in state "0", the interactive mode of operation is placed in operation. In response to the "0" state for this signal, data select and adder 209 adds the data read out from the loudness scalers 207 and 208 in an adder-accumulator contained within the data select and adder 209. This accumulator is initialized each time that the flip-flop 211 returns to its initial state.

The summed state is transferred by AND-gate 283 to the nonlinear data memory 214 when the two output signals from the loudness scalers have been added together. In the absence of an input data value, a zero value is read out of the nonlinear data memory 214. This happens during the time that data is read out of the loudness scaler 207 but no data is transferred by the AND-gate 283.

The net tonal result of the interactive mode of operation is a tone generation characterized by the sums and difference of spectral terms similar to those produced by transforming two (or more) complex waveshapes through a nonlinear transformation system. It is a feature of the present invention that this complex resultant waveshape is produced by a sequence of linear operations which do not require or use a multiplication of signal waveshapes. Thus while the resultant tones can duplicate the effects of a ring modulator, there is no need for the balanced modulators or multiplication devices usually used in implementing ring modulators. The resulting tone components are a function of the transfer data values stored in the nonlinear data memory, the magnitudes of the two loudness control signals, the state of harmonic formant subsystem, and the frequency separation of the tone generators. This combination of control leads to a very wide variety of tonal effects.

The system shown in FIG. 3 can readily be extended to any desired number of tone generators. For more than two tone generators the flip-flop 211 is replaced by a counter so that the count states are used to access data from a multiplicity of loudness scalers in the usual time shared fashion of selecting data from a multiplicity of sources. The adder-accumulators in logic blocks 278 and 209 are implemented to initialize at the end of the count states of this counter.

Figure 4:
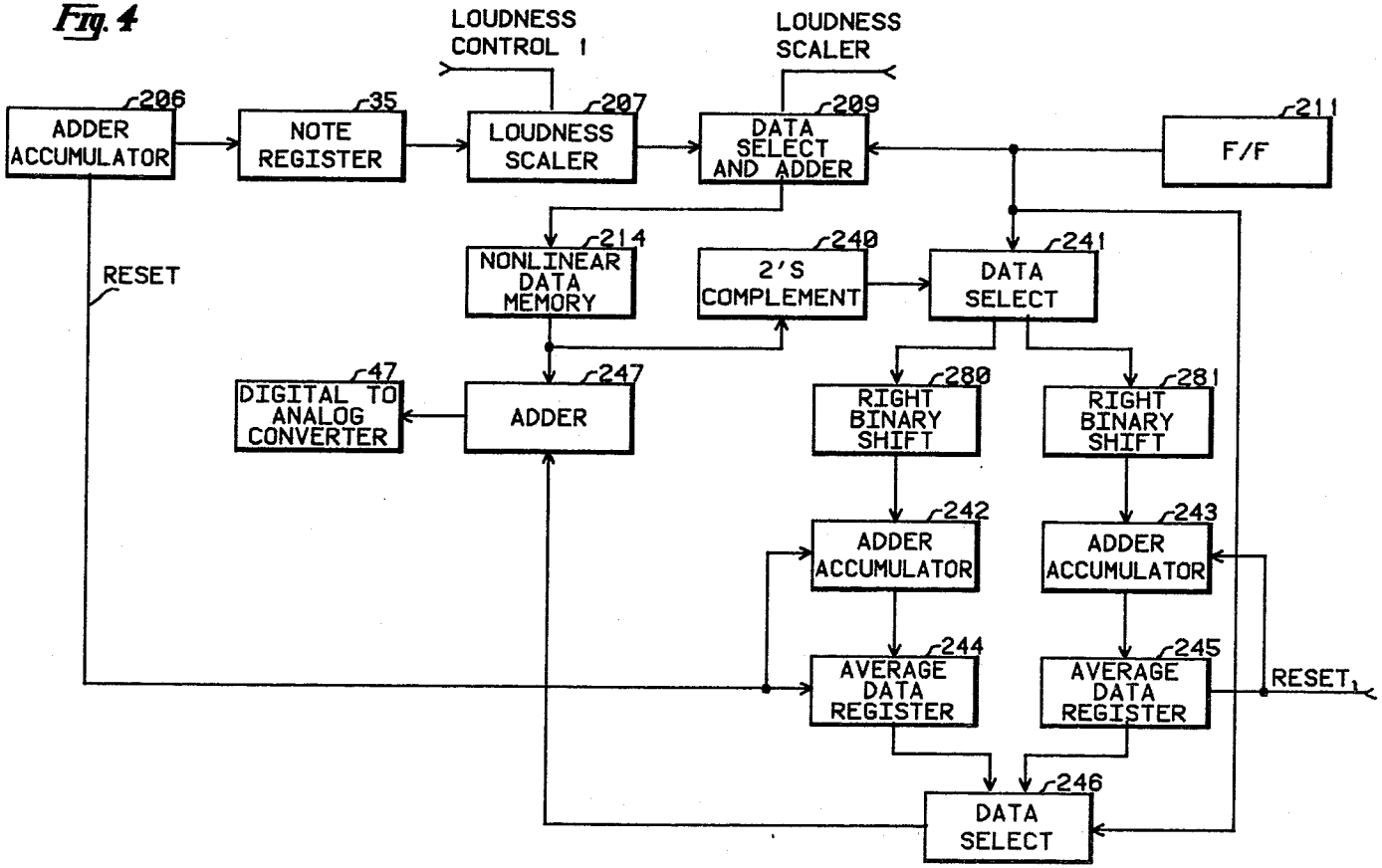
FIG. 4 is a schematic block diagram of a subsystem to remove the signal average value.

FIG. 4 shows a method for eliminating variations in the average value of data read out of the nonlinear data memory 214 by forcing the average value to always have a zero value. If this average value is not maintained at a zero value, then for many sound systems objectionable "clicks" will be heard each time that a signal loudness control changes the average value.

In FIG. 4, the transfer data values read out from the time shared nonlinear data memory 214 is converted into negative values by means of the 2's complement 240. The 2's complemented data is selectively divided into two channels by means for the data select 241 in response to the states of the flip-flop 211.

The selected outputs from the data select 241 ard divided by 64 in the right shift 281 and 282. This corresponds to the number of data points in a master dats set. The division is accomplished by shifting the data by 6 binary bit positions to the right.

The selected data for the first channel is added to itself in the adder-accumulator 242. When adder-accumulator 206 resets itself because of its modulo accumulation implementation, a RESET signal is generated. This RESET signal causes the current data value in the adder-accumulator 242 to be transferred and stored in the average data register 244. The RESET signal is also used to initialize the accumulator in the adder-accumulator 242 after the data transfer has been completed. The net result is that the average data register 244 contains a value which is very close to the negative of the average value of data read out of the nonlinear data memory 214 for one cycle of the tone generated from data read out of note register 35.

The negative average values generated for the two channels are selected in turn by the data select 246 in response to the states of the flip-flop 211. The selected negative average values are added by means of adder 247 to the transfer data values read out of the nonlinear data memory 214. The result of this processing is that the data for the current waveshape period is processed by removing the average value for the immediate preceding waveshape period. Since the loudness control signals normally vary at a rate slower than a waveshape period, the action described is essentially equivalent to creating waveshape data having an average value equal to, or close to, a zero value.

The task of eliminating the average value of the generated digital waveshape data can be completely eliminated by using an alternative implementation for obtaining the transfer data values that are stored in the nonlinear data memory 214. The alternative generation method is based upon the observation that if the transfer data values are constructed with odd-symmetry about the midpoint of the data set, then the data addressed out from the nonlinear data memory 214 which addresses having equal deviations in both direction from the midpoint will produce output data values having a zero average value.

Transfer data values having odd-symmetry can be generated by a modification to the system shown in FIG. 2. The polynomial Table 218 is replaced by a sinusoid table storing values of the trigonometric sine function. When this replacement is made, the transfer data set residing in the transfer data register 230 is computed in a manner analogous to that described in the referenced U.S. Pat. No. 4,085,644 for computing the master data set. In this fashion the transfer data values will be odd-symmetric about their midpoint.

Figure 5:
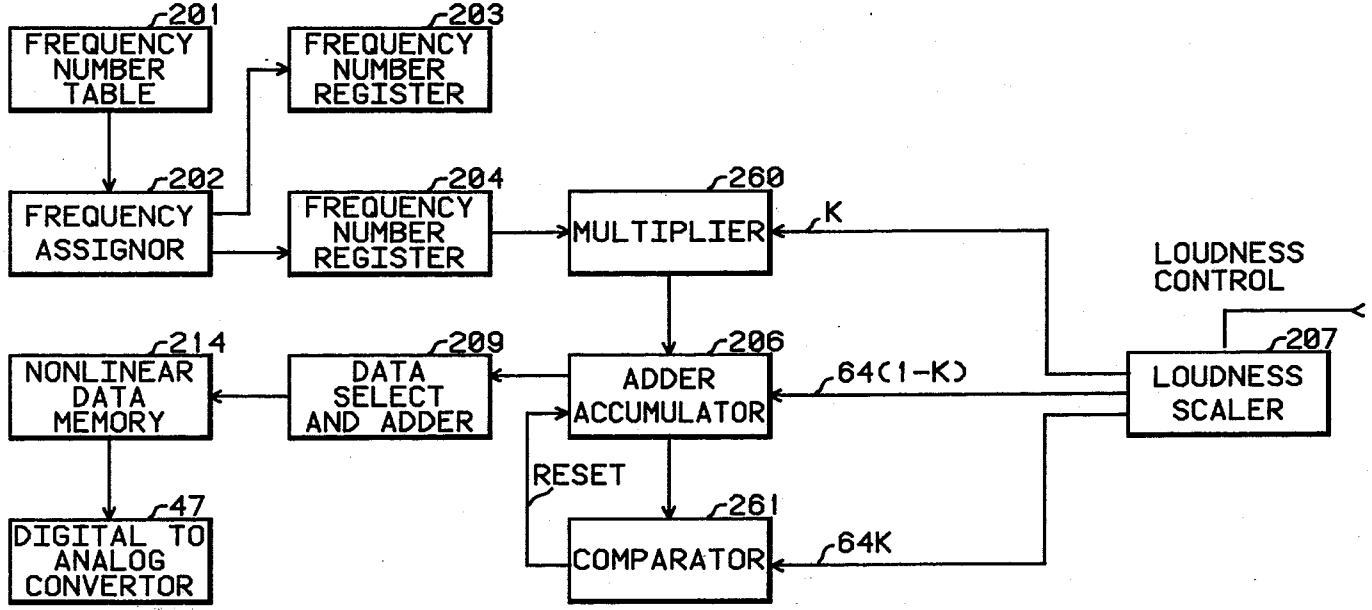
FIG. 5 is a schematic block diagram of an alternative data read out system.

The data read out system shown in FIG. 3 and previouously described is now modified as shown in FIG. 5. The output data from the adder-accumulator 206 to the data select and adder 209 will be of a repeating sawtooth form having a period determined by the assigned frequency number residing in the frequency number register 204. The sawtooth data values are generated, in the manner described below, about the midpoint of 32 (assuming that the generated waveshapes have a period consisting of 64 data points) and having a peak amplitude excursion determined by the level of the loudness control signal.

The loudness cocontrol signal is selected to have a value k lying in the numerical range of $0<k<1$. The value of k is transmitted to the multiplier 260 which multiplies the assigned frequency number contained in the frequency number register 204 by the value of k. The scaled frequency number produced by the multiplier 260 is transmitted to the adder-accumulalator 206. This adder-accumulator adds the scaled frequency number successively to the contents of its accumulator.

The value of 64 xk is transferred from the loudness scaler 207 to the comparator. This value can be obtained by a left shift of 6 bits for the binary data word representing the value of k. When the comparator 261 determines that the current content of the adder-accumulator 206 is greater than or equal to the value 64 k, a RESET signal is generated. In response to this RESET signal, the accumulator in the adder-accumulator 206 is reset to the value of 64 $(1-k)$ which is generated by and transmitted from the loudness scaler 207. The net result of this action is that the adder-accumulator 206 creates the desired symmetrical excursions of the sawtooth data about the midpoint of 32. Since the transfer data values stored in the nonlinear data memory 214 were generated to be odd-symmetric with respect to the address point 32, the generated musical tones will have waveshapes with a zero average value.

The value of 64 $(1-k)$ is produced by the loudness scaler 207 by complementing the binary value of k and then performing a left binary shift of 6 bit portions.

Figure 6:
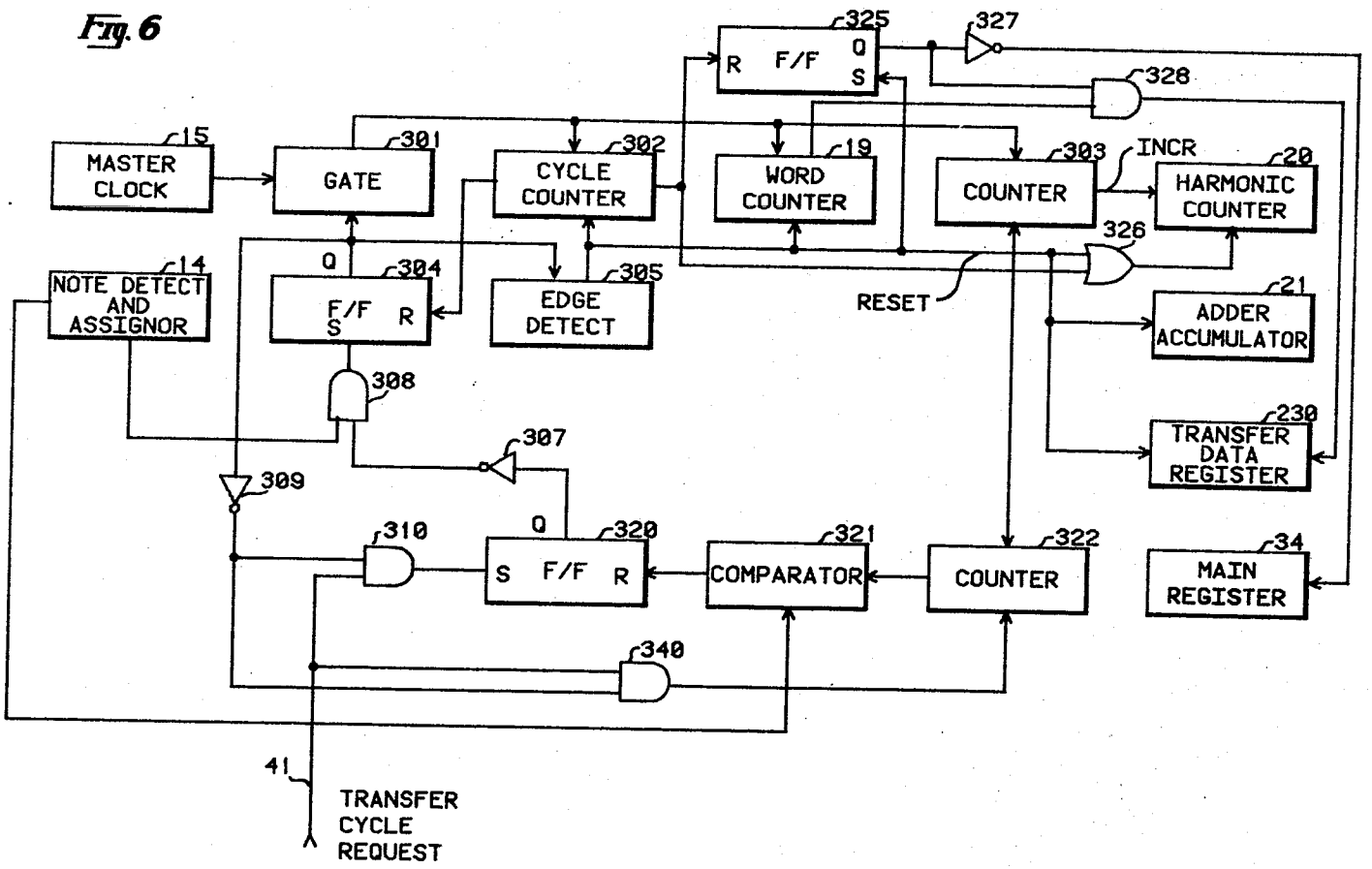
FIG. 6 is a schematic diagram showing details of the executive control.

FIG. 6 shows details of the executive control 16. The system elements in FIG. 6 having labels in the 300-number series are elements of the executive control 16. A complete computation cycle consisting of a first subcomputation cycle is initiated when flip-flop 304 is set so that its output state is Q="1". Flip-flop 304 can be set at a request from the note detect and assignor 14 if flip-flop 320 has its output state at Q="0". As described below, flip-flop 320 is used to control a transfer cycle. It is desirable that a computation cycle not be initiated while a transfer cycle is in progress. Note detect and assignor 14 will generate a request for the start of a computation cycle if this subsystem has detected that a keyswitch has been actuated on the musical instrument's keyboard. An alternative system operation logic is to always initiate a complete computation cycle when a transfer cycle is not in progress, or to initiate a computation cycle at the completion of each transfer of data to a note register and to a nonlinear-data memory.

When flip-flop 304 is set at the start of a computation cycle, the output state Q="1" is converted into a signal pulse, labeled RESET, by means of the edge detect circuit 305. The RESET signal is used to initialize counters 302, 19, 303, 322, and 303. It is also used to initialize the adder-accumulator 210 and the transfer data register 230.

The state Q="1" of flip-flop 304 causes gate 301 to transfer clock timing signals from the master clock 15 to increment the cycle counter 302 and the word counter 19.

The RESET signal generated by the state Q="1" sets the flip-flop 325 which is used to initialize the main register 34 during the second subcomputation cycle.

Counter 303 is implemented to count modulo 32 which is the maximum number of harmonics used to generate the master data set and the transfer data set. Each time the contents of this counter is reset because of its modulo counting action, and INCR signal is generated which is used to increment the count state of the harmonic counter 20.

During the first subcomputation cycle, counter 302 counts a total of 64×32 master clock timing signals. When this count is reached a signal is sent to reset the flip-flop 325 and to reset the harmonic counter. In response to the state Q="0" of the flip-flop 325, the contents of the main register 34 are initialized. At this time the second subcomputation cycle starts.

When the cycle counter advances another 64×32 counts for a total of 2×64×32 master clock timing signals, it generates a signal which is used to reset the flip-flop 304 thereby ending the computation cycle. AND-gate 328 prevents data from being read out of, or into, the transfer data register during the second subcomputation cycle.

A transfer cycle request on line 41 will set flip-flop 320 if a computation cycle is not in progress as indicated by a state Q="0" for the flip-flop 304.

The number of currently assigned tone generators is transferred from the not detect and assignor 14 to the comparator 321. Counter 322 is incremented by the transfer cycle requests on line 41 if a computation cycle is not in progress. When the count state of the counter 322 is incremented to the number of assigned tone generators contained in the comparator 321, a signal is created which resets the flip-flop 320. The state Q="0" of flip-flop 320 permits the start of a new computation cycle.

I claim:

1. In a musical instrument having one or more tone generators, in which a plurality of data words corresponding to the amplitudes of a corresponding number of evenly spaced points defining the waveform of a musisical tone are computed and transferred sequentially to a digital-to-analog converter at a rate proportional to the pitch of the tone being generated, apparatus for generating tones having a variable spectral content comprising;

a first means for computing transfer data values during the first subcomputation cycle of a sequence of computation cycles each comprising a first and a second subcomputation cycle, a first memory means for storing said transfer data values, a second means for computing data values of a master data set during said second subcomputation cycle, a second memory means for storing said master data set, a third memory means for storing data to be thereafter read out, a first data transfer means whereby said master data set is read out of said second memory means and stored in said third memory means, a first addressing means for sequentially and repetitively reading out data stored in said third memory means, control signal generation means for generating a control signal, a second addressing means responsive to said control signal and data read out of said third memory means whereby transfer data values are read out from said first memory means, and means for producing musical signal waveshapes from transfer data values read out from said first memory means.

2. In a musical instrument according to claim 1 wherein said first means for computing transfer data values comprises;

a word counter incremented at each computation time in said first subcomputation cycle wherein said word counter counts modulo the number M of said transfer data values, modulo reset circuitry whereby a reset signal is created when said word counter returns to its initial state, a harmonic counter incremented by said reset signal, a plurality of orthogonal function memory means for storing values of an orthogonal function, a third addressing means whereby a member of said plurality of orthogonal function memory means is selected corresponding to the contents of said harmonic counter and whereby values of said orthogonal function are read out from said selected orthogonal function memory means in response to contents of said word counter, a first coefficient memory for storing a first set of harmonic coefficient values, a first coefficient memory addressing means responsive to contents of said harmonic counter for reading out harmonic coefficient values from said first coefficient memory, a first multiplier means for generating the multiplied product of harmonic coefficient values read out from said first coefficient memory by said values of an orthogonal function read out from said plurality of orthogonal function memory means, a first means for successively algebraically summing said multiplied product with data values read out from said first memory means in response to contents of said word counter, and a fourth addressing means responsive to contents of said word counter whereby contents of said means for successively algebriacally summing are stored in said first memory means.

3. In a musical instrument according to claim 2 wherein said first means for computing transfer data values further comprises;

a formant coefficient means for storing a set of formant coefficient values, a formant clock for providing a sequence of formant timing signals, a comparator means responsive to said formant timing signals wherein formant addressing signals are generated, a formant addressing means whereby formant coefficient values are read out of said formant coefficient means in response to said formant addressing signals, and a formant multiplier means interposed between said first coefficient memory and said first multiplier means wherein said formant coefficient values read out of said formant coefficient means are multiplied by said harmonic coefficient values read out from said first coefficient memory and whereby the multiplied values are provided to said first multiplier means.

4. A musical instrument according to claim 3 wherein said comparator means further comprises;

a first signal generation circuitry responsive to said sequence of formant timing signals and to contents q of said harmonic counter whereby a formant addressing signal of unit magnitude is generated if $q+u$ is not greater than a preselected constant $q_c$ and whereby a formant addressing signal of magnitude $q+u-q_c$ is generated if $q+u$ is greater than said constant $q_c$ and where u is an index number denoting a member of said sequence of formant timing signals.

5. A musical instrument according to claim 3 wherein said comparator means further comprises;

a second signal generation circuitry responsive to said sequence of timing signals and to contents q of said harmonic counter whereby a formant addressing signal of unit magnitude is generated if $q+u$ is not less than a preselected constant $q_c$ and whereby a formant addressing signal of magnitude $q_c-(q+u)$ is generated if $q+u$ is less than said constant $q_c$ and where u is an index number denoting a member of said sequence of formant timing signals.

6. A musical instrument according to claim 2 wherein said second means for computing data values of a master data set comprises;

a sinusoid table storing values of trigonometric sinusoid functions, an adder-accumulator means initialized at the start of said second subcomputation cycle for successively adding and storing the contents of said harmonic counter, a sinusoid addressing means for reading out values of trigonometric sinusoid functions from said sinusoid table in response to contents of said adder-accumulator means, a second coefficient memory for storing a second set of harmonic coefficient values, a second coefficient memory addressing means responsive to contents of said harmonic counter for reading out harmonic coefficient values from said second coefficient memory, a second multiplier means for generating the multiplied product of harmonic coefficient values read out from said second coefficient memory by said values of trigonometric sinusoid functions read out from said sinusoid table, a second means for successively algebraically summing said multiplied product generated by said second multiplier means with data values read out from said second memory means in response to contents of said word counter, and a fifth addressing means responsive to contents of said word counter whereby contents of said means for successively algebraically summing are stored in said second memory means.

7. A musical instrument according to claim 1 wherein said second addressing means comprises;

scaling circuitry wherein data read out of said third memory means are multiplied by a scale factor selected by said control signal to produce scaled addressing data values, and addressing circuitry responsive to said scaled addressing data values for reading out transfer data values from said first memory means.

8. A musical instrument according to claim 7 wherein said scaling circuitry further comprises;

a scale factor memory for storing a plurality of data values comprising said scale factors, and a scale factor memory addressing means for accessing a scale factor from said scale factor memory in response to said control signal.

9. A musical instrument according to claim 1 wherein said means for producing musical waveshapes comprises;

2's complement circuitry for forming the binary 2's complement of transfer data values read out of said first memory means, division circuitry wherein output data values formed by said 2's complement circuitry are divided by a number equal in magnitude to the number of data elements in said master data set, an averaging adder-accumulator means for successively adding and storing the data values produced by said division circuitry, and an adder means for adding contents of said averaging adder-accumulator means with transfer data values read out of said first memory means.

10. In a musical instrument having one or more tone generators, in which a plurality of data words corresponding to the amplitudes of a corresponding number of evenly spaced points defining the waveform of a musical tone are computed and transferred sequentially to a digital-to-analog converter at a rate proportional to the pitch of the tone being generated, apparatus for generating tones having a variable spectral content and nonharmonic overtones comprising;

a first means for computing transfer data values during the first subcomputation cycle of a sequence of computation cycles each comprising a first and a second subcomputation cycle, a transfer memory means for storing said transfer data values, a second means for computing data values of a master data set during said second subcomputation cycle, a main memory means for storing data values of said master data set, a plurality of note memory means for storing data to be thereafter read out, a first data transfer means whereby data values of said master data set are read out of said main memory means and stored in each member of said plurality of note memory means, a plurality of note addressing means, each associated with a corresponding member of said plurality of note memory means, for sequentially and repetitively reading out data stored in each of said plurality of note memory means, a transfer addressing means for addressing data values from said transfer memory means in response to data read out of said plurality of note memory means, and means for producing musical signal waveshapes from transfer data values addressed out from said transfer memory means.

11. A musical instrument according to claim 10 wherein said transfer addressing means comprises;

a plurality of scaling means, each associated with a corresponding member of said plurality of note memory means, wherein data read out of said plurality of note memory means are multiplied by scale factors selected by a plurality of control signals thereby forming scaled data values, and combination circuitry responsive to a mode control signal whereby said scaled data values corresponding to each element of said plurality of note memory means are added together to form combined data values if said mode control signal is present and whereby said scaled data values corresponding to each element of said plurality of note memory means are not added together to form a combined data values if said mode control signal is not present, and wherein transfer data values are read out from said first memory means in response to said combined cata values.

12. A musical instrument according to claim 11 wherein said plurality of scaling means comprises;

a plurality of scale factor memory means, each associated with a corresponding member of said plurality of note memory means, for storing a plurality of data values comprising said scale factors, and scale factor memory addressing means, each associated with a corresponding member of said plurality of scale factor memory means, for accessing scale factors from said plurality of scale factor memory means in response to said plurality of control signals.

* * * * *